United States Patent [19]

Knauss

[11] Patent Number: 4,926,030

[45] Date of Patent: May 15, 1990

[54] END PIECE FOR TUBULAR HEATER

[75] Inventor: Hermann Knauss, Oberderdingen, Fed. Rep. of Germany

[73] Assignee: E.G.O. Elektro-Gerate Blanc u. Fischer, Fed. Rep. of Germany

[21] Appl. No.: 303,573

[22] Filed: Jan. 27, 1989

[30] Foreign Application Priority Data

Feb. 12, 1988 [DE] Fed. Rep. of Germany ..... 3804326

[51] Int. Cl.[5] ..... H05B 3/40

[52] U.S. Cl. ..... 219/541; 219/544; 219/548; 338/274

[58] Field of Search ..... 219/541, 542, 544, 546, 219/548; 338/274; 174/77 R

[56] References Cited

U.S. PATENT DOCUMENTS 2,489,998 11/1949 Charbonneau et al. ..... 201/67

FOREIGN PATENT DOCUMENTS 1615302 5/1970 Fed. Rep. of Germany .
7534697 2/1976 Fed. Rep. of Germany .
2818046 12/1978 Fed. Rep. of Germany .
7913329 10/1979 Fed. Rep. of Germany .
199390 1/1939 Switzerland .
1122260 8/1968 United Kingdom .
1224021 3/1971 United Kingdom .
1224631 3/1971 United Kingdom .

*Primary Examiner*—Bruce A. Reynolds
*Assistant Examiner*—Leon K. Fuller
*Attorney, Agent, or Firm*—Steele, Gould & Fried

[57] ABSTRACT

An end piece (1) for a tubular heater (2) has an insulator (10) traversed from the end portion (8) by its connecting member (6) in a passage (16) and substantially completely closing the associated end portion (7) of tube casing (3) and on whose end face (19) remote from the tubular heater (2) is provided a separate metal connecting piece (20) welded to the associated end face of connecting member (6) by a welding head (33). Connecting piece (20) forms one or more freely projecting elements (25) for direct connection to electrical leads. Thus, end piece (1) is positively secured with respect to the tubular heater (2) and is suitable for an easy electrical connection, which can be released at any time.

24 Claims, 2 Drawing Sheets

FIG. 8
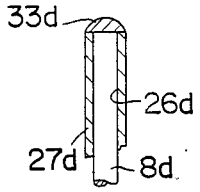
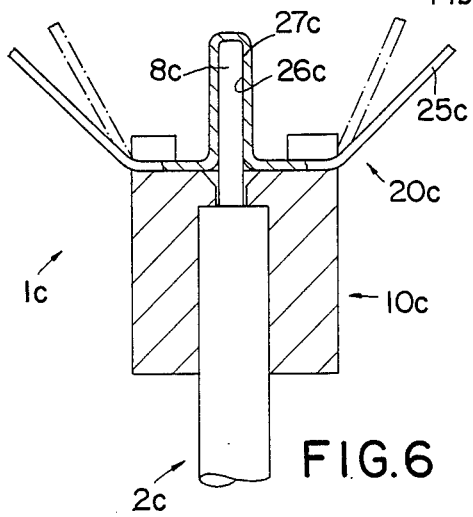
FIG. 6
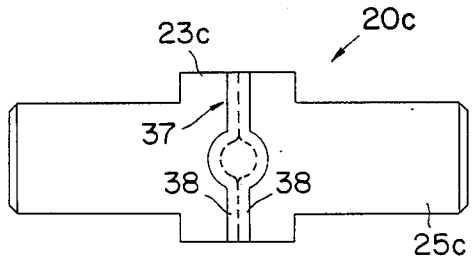
FIG. 7
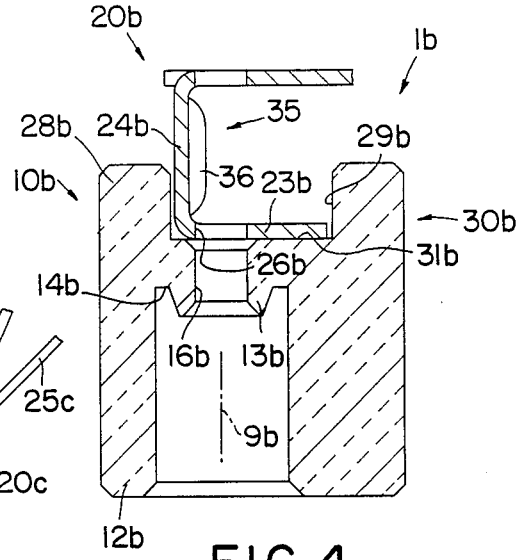
FIG. 4
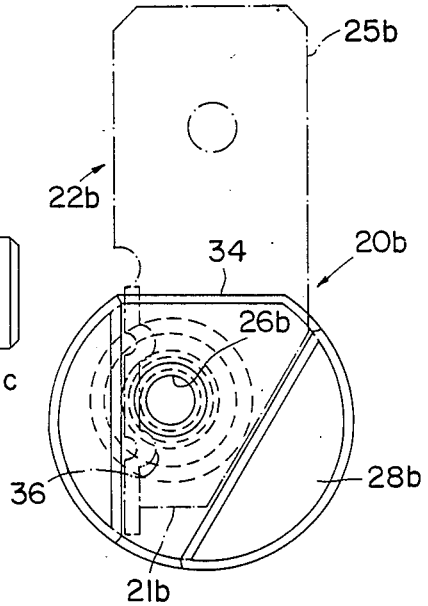
FIG. 5

END PIECE FOR TUBULAR HEATER

BACKGROUND OF THE INVENTION

1. Field of the Invention

The invention relates to an end piece, which is in particular intended as an end termination for tubular heaters and similar heating resistor units or elongated bodies and which is preferably constructed for the direct engagement in a short, associated end portion of said body.

For connection to the tubular heater or the like, the end piece can have an engagement member, which appropriately has a passage for a member e.g. projecting roughly in the axis of the tubular heater beyond the end thereof, namely mainly a wire-type connecting member. Advantageously the end piece is essentially constructed as an insulator from a high temperature-resistant, ceramic insulating material.

2. Prior Art

For the termination of tubular heaters so-called beads are known similar to those used for the distributed bead insulation of bare line wires. The end piece then comprises a single, one-part bead having at one end a projecting engagement sleeve portion adapted to the inside diameter of the tube casing and a widened collar connected thereto, which connecting on to the associated face of the tube casing is located outside the same. In the central axis the bead has a throughbore through which the lead, located in the interior of the tube casing and connected to the heating resistor, is passed in such a way that it forms an end portion projecting freely over the outer end of the bead, which can be used for the electrical connection of the tubular heater. Electrical connection by means of this wire end is usually very difficult and can only be carried out by means of nondetachable joints, such as welded joints, so that special skill is required. The connection between the end piece and the tubular heater is frequently not adequate, so that with time the end piece can become loose or detached.

SUMMARY OF THE INVENTION

An object of the invention is to so construct an end piece of the aforementioned type that, in the case of simple construction, allows an easily handleable construction of the end of the tubular heater or the like.

According to the invention this object is achieved by an end piece with at least one engagement member formed by the insulator or at least partly by a further body and which is located outside the tube casing and which can be designed for the desired functions depending on the requirements. For example, it can be constructed as an orienting aid or gripping portion for a robot, as a mounting support for a connecting element, or as a connecting element for electrical connection, or a grounding connection, as a protective jacket for the end of the tubular heater, as a fixing element for fixing purposes or for the centered alignment of the tubular heater in its assembly state, etc.

According to a preferred embodiment, in place of a tube casing engagement member or in additon thereto at least one connecting engagement member is provided for the embedded reception or reception merely by external engagement of a connecting piece made from electrically conductive material and which despite direct contact is electrically insulated with respect to the connecting member of the tubular heater or between said connecting member and the tube casing forms an intermediate insulation in one part therewith. The connecting piece is e.g. fixed by welding to the connecting member or is detachably connected thereto, so that with the latter and the insulator it forms a prefabricated, closed assembly from preferably non-detachable parts.

According to the invention there is for the end piece a positive or nondetachable axial and/or rotational positional securing, the securing member preferably being formed by the connecting piece fixed with respect to the free end of the connecting member in such a way that between the securing member and the facing face of the tube case is fixed an insulator portion or is rotationally secured or axially secured with a limited clearance of motion. The connecting piece can be designed in an almost random manner for adapting to the particular connecting counterparts to be used, e.g. one, two, four or more separate connecting elements, such as connecting terminals, connecting plugs, welded joint connecting elements, etc. One or more connecting elements either project in exposed manner and/or shielded. However, they can be located in a manner free for connection within a separate part or within the insulator of the end piece.

The securing member or connecting piece appropriately has a fixing part, which in the manner of a retaining ring is provided with a plugging opening closely adapted to the connecting member and which is directly connected to the associated end of the passage in the insulator e.g. formed by a substantially cylindrical bore. According to the invention the end piece can form a cover surrounding the connecting member substantially over its entire length projecting over the tube casing or the insulator and/or over the entire circumference, so that the lead of the tubular heater is not exposed at any point. The lead part projecting over the insulator can be covered by the connecting piece. It is conceivable to construct the boundary of the plugging opening in the manner of a circlip as a claw for a barb-like claw engagement with respect to the connecting member, or the end of the latter can be provided with an external thread for receiving a lock nut. However, a particularly advantageous connection to the connecting piece is obtained if there is a welded joint, e.g. a point or spot welding head located only at the terminal face of the connecting member and adjacent zones of the connecting piece.

For connection to the insulator the connecting piece appropriately has a fixing part, which is countersunk and substantially completely covered within the insulator or can follow on to an associated outer face of the insulator. This fixing part can in a very simple manner be formed by an e.g. U-shaped sheet metal profile, which can engage on the insulator with the profile cross-web or in place thereof or in addition thereto with a profile leg. If the profile legs pass directly into the connecting elements or if they form said connecting elements, a very simple construction is obtained. For securing the connecting piece in several or all directions at right angles to the axis of the tubular heater end, there are appropriately interengaging members between the fixing part and the insulator, which appropriately has on its associated outer or end face profile projections engaging in the outer edges of the fixing part, so that the latter, apart from the plugging opening for the connecting member, does not have to have any further circumferentially closed openings.

Particularly in the case of a substantially cylindrical or rotationally symmetrical construction of the insulator, it is appropriate if the fixing part is in axial view width-tapered to an end remote from the connecting elements, so that despite relatively small width of the insulator relatively large projections can be constructed and it is possible to achieve a particularly simple, prism-like alignment of the fixing part with respect to the insulator and therefore the plugging opening with respect to the passage.

To provide a secure connection between the securing or connecting piece and the connecting member, particularly if when constructing the fixing part from sheet metal the axial extension of the plugging opening would only correspond to the sheet metal thickness, the plugging opening is provided with an axial extension greater than the latter, namely is e.g. limited by a sleeve part, which in simple manner can be shaped out of the connecting piece. This sleeve part also forms an inner blind hole base face or an exposed, circular end face, which in one plane can be located with the associated end face of the connecting member of the tubular heater, so that a very secure connection is ensured together with precise orientation.

To ensure that no separate welding material has to be supplied for the welded joint, in the vicinity of the plugging opening and/or the end of the connecting member of the tubular heater, the fixing part can be provided with a welding material supply, which is melted on producing the welded joint and directly forms the material for producing the latter. The welding material can also be formed by an end wall closing the blind hole-type plugging opening at the associated end.

In the case of a correspondingly long construction of the plugging opening, which is several times longer than the cross-sectional width or diameter of the connecting member, it can form a very precise sliding guide for the connecting member on insertion. However, if the fixing part of the connecting piece only has a short plugging opening or two spaced, equiaxial and in each case short plugging openings, then it is appropriate following on to the plugging opening or between the individual plugging openings to provide an additional, e.g. slot or prism-like longitudinal guide for the connecting member, which in simple manner can be formed by a profile portion of the fixing part and projections projecting over the same on either side of the central axis of the plugging opening. If the projections are shaped in bead-like manner from the fixing part, they simultaneously reinforce the same.

To achieve a hermetic seal of the end of the tubular heater or tube casing, the end piece or insulator appropriately has a sleeve-like socket closely surrounding the associated end of the tubular heater on the outer circumference thereof and whose inside width is greater than the inside diameter of the passage, so that it passes into the same by means of an offset, inner, ring-like shoulder. For the secured termination of the tubular heater end, in place thereof or in addition thereto it is possible to provide a sleevelike ring plug projecting less far from the inner shoulder than the socket, which narrowly engages in the inside of the tube casing and engages with its face on the compressed insulating material, with which the tube casing is filled between its inner circumference and the outer circumference of the connecting member. The passage for the connecting member consequently passes continuously through the ring plug.

These and further features of preferred developments of the invention can be gathered from the claims, description and drawings. The individual features can be realized individually or in the form of subcombinations in an embodiment of the invention and in other fields and constitute advantageous, patentable constructions, for which protection is claimed.

BRIEF DESCRIPTION OF THE DRAWINGS

An embodiment of the invention is described in greater detail hereinafter relative to the drawings, wherein are shown:

FIG. 4: Another embodiment of an end piece in axial section.

FIG. 5: The end piece according to FIG. 4 in plan view.

FIG. 6: Another embodiment of an end piece in axial section.

FIG. 7: The connecting piece according to FIG. 6 in plan view.

FIG. 8: A detail of FIG. 6 in a modified construction.

DETAILED DESCRIPTION OF THE PREFERRED EMBODIMENT

Figures 1, 2, 3:
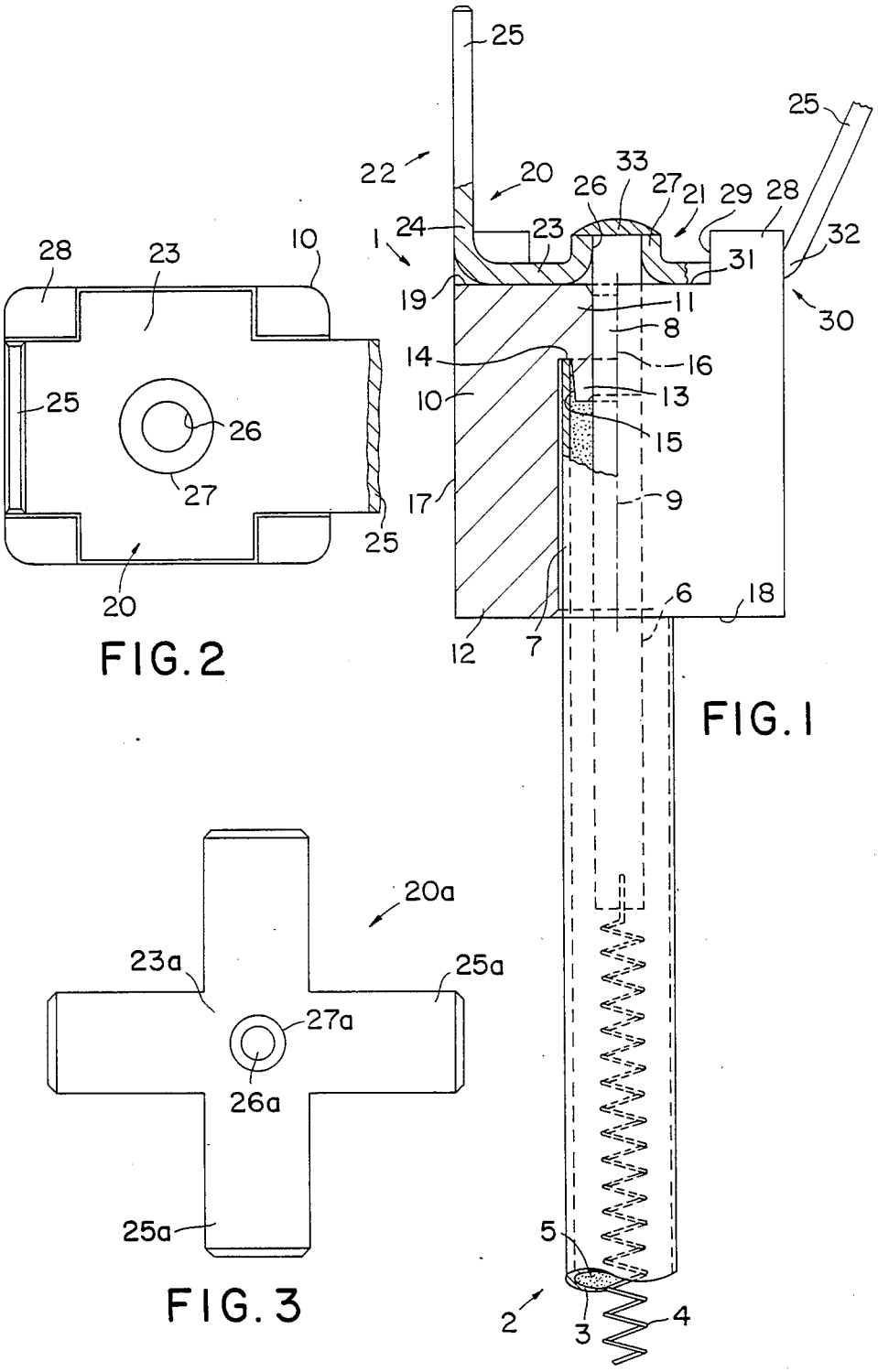
FIG. 1: An inventive end piece fitted to one end of a tubular heater in a part sectional view.
FIG. 2: A plan view of the end piece according to FIG. 1.
FIG. 3: Another embodiment of a connecting piece in a representation corresponding to FIG. 2.

The end piece 1 according to FIGS. 1 and 2 is used for arrangement on one end of a tubular heater 2 and as a rule on both ends of said heater 2 are arranged identical or comparable, or also differently constructed end pieces. Tubular heater 2 has a cross-sectionally circular, oval, approximately isosceles or equilateral triangular, or other non-circular tube casing 3 within which and in the central axis is provided a heating resistor 4 extending over most of its length in the form of a resistance wire coil, which is placed in a compressed insulating material 5 in such a way that the heating resistor 4 is contact-free with respect to the tube casing 3.

Within the tube casing 3 and spaced from its associated end, to the corresponding end of the heating resistor 4 is connected a connecting member 6 in the form of a wire rod located in the central axis of the associated end portion 7 of the tube casing 3 and whose diameter, which is smaller than the inside width of the casing 3, is approximately the same as the external diameter of the wire coil of heating resistor 4. Connecting member 6 is also embedded in the insulating material 5 and projects with a linear end portion 8 over the associated end face of the tube casing 3 by a relatively small amount, namely e.g. 1.5 to 7 times, preferably 2 to 3 or at the most 5 times its external diameter. Connecting member 6 is linear over its entire length, so that it can be turned slightly with the end portion for the alignment of the latter. However, the tubular heater is appropriately bent several times between its linear end portion 7, e.g. it is constructed in such a way that its ends project freely in the same direction and parallel to one another and consequently its two end portions are so juxtaposed that they can be optionally combined or interconnected to from a closed assembly or can have a common insulator.

End piece 1 has an insulator 10 substantially symmetrical to the central axis 9 and which, apart from being made from a ceramic material, can in particular be made from plastic, if the associated end of the heating coil 4 is spaced by a corresponding length of the connecting member 6 from the insulator 10 to the extent that at its connecting or engaging end portion 7 it has an adequately low temperature in operation. The through one-part or single insulator 10 is provided in the vicinity of its end with a circular end wall 11 from which projects a socket 12, whose largest wall thickness is of the order of magnitude of the diameter of the tube casing 7 and whose inside cross-section is closely adapted to the external cross-section of the tubular heater 2 or tube casing 3. Socket 12 engages over the metal tube casing 3 by several times the length compared with its external diameter, particularly 1.5 to 4 times or preferably approximately 2.5 times, so that a very accurate and substantially clearance-free centering of these two parts is ensured.

From the inner face of end wall 11, a sleeve-like ring plug 13 projects in the same direction as socket 12, which has a minimum radial spacing from the inner circumference of socket 12 roughly corresponding to the wall thickness of tube casing 3, so that between the inner circumference of socket 12 and the outer circumference 15 of ring plug 13 is formed a circular groove 14 corresponding to the cross-section of casing 3 and whose depth corresponding to the axial extension of ring plug 13 is smaller than the external diameter of tubular heater 2 and is preferably approximately half or less than said external diameter. The external circumference of the ring plug 13, which is several times shorter than the socket 12, is conically tapered towards its free end, so that the width of the circular groove 14 decreases in acute angled manner to its base. The end face of the tube casing 3, having a constant cross-section throughout, engages on the base surface of circular groove 14, so that the ring plug 13 engages with its entire length in the end portion 7 and is pressed with its end face on the end face of the insulating material 5, set back with respect to the end face of tube casing 3 as a closure.

End wall 11 is traversed by a bore-like passage 16 cross-sectionally closely adapted to the connecting member 6 or its end portion 8 and which conically widens in funnel-shaped manner at both ends and continues through the ring plug 13. The end portion 8 of connecting member 6 engages in substantially clearance-free manner in said passage 16, connected directly to the insulating material 5, so that a very reliable supporting of the end portion 8 continuing over its entire length is ensured. The external shape of the insulator 10 can be adapted to the particular requirements. Considered in the direction of the central axis 9 according to FIG. 2, the insulator can have a circumferential surface 7 diverging from the circular shape, e.g. an elongated-rectangular, square, triangular, oval or similar external shape. This shape can correspond to the external cross-section of the tubular heater 2 and in the case of an external cross-section of the tubular heater 2 differing from the circular it can be oriented in the same direction.

The central axis of the insulator 10 can also be displaced with respect to that of the end portion 7 of tubular heater 2, e.g. parallel, so that an eccentric positioning of end piece 1 with respect to end portion 7 is obtained and consequently there is a possibility of so arranging end piece 1 by turning with respect to the tubular heater 2, that it can be easily housed under the given spatial conditions. Eccentric construction also provides an adjustment means making it possible to compensate tolerances between a carrier receiving the end piece and the end portion 7 of tubular heater 2 by turning the insulator 10. The preferably substantially planar and parallel end faces 18, 19 of insulator 10 are appropriately at right angles to the central axis 9, so that the insulator 10 can be formed by a cubic body with substantially planar outer faces at right angles to one another.

The end wall 11, having a smaller thickness than the external diameter of tubular heater 2 and defined between the base surface of circular groove 14 and the outer end face 19 remote therefrom, is used for receiving a metallic connecting piece 20, which is preferably constructed as a stamped bent part and which appropriately in the axial view according to FIG. 2 is located substantially within the outer contours of insulator 10 or with a fixing part 21 extending at the most up to said outer contours, while a connecting part used for the electrical connection can project over said outer contours at least to one side of the insulator 10. The approximately flat U-shaped fixing part 21 in the cross-section according to FIG. 1 forms with its cross-section a substantially planar plate portion 23, which on at least two facing sides passes in one piece into profile legs 24, directed away from the insulator 10 or the end face 19. The extended ends of these profile legs 24 are in the form of freely projecting connecting elements 25, preferably as flat plugging tongues constructed in one piece with the fixing part 21 and to which can be directly connected leads with corresponding mating connectors.

With its side facing the insulator 10, the approximately ring disk-like plate portion 23 engages preferably substantially in clearance-free manner on end face 19. The fixing part 21 is directly secured with respect to the tubular heater 2 or connecting member 6, so that the insulator 10 is fixed between the end face of tube casing 3 and the fixing part 21. For securing and for an electrically conducting connection, the fixing part 21 is provided in the center of its plate portion 23 with a plugging opening 26 roughly with the same cross-section or width as the passage 16. However, the axial extension of this plugging opening 26, directly connected to passage 10, is much smaller than that of passage 16. The plugging opening 26, which is longer than the thickness of plate portion 23, is bounded by a sleeve-like collar 27 shaped out in one piece from the plate portion 23 and which is appropriately directed away from the end face 19.

Collar 27 could also be directed against end face 19 or insulator 10 and could e.g. engage in a widened portion of passage 16 adapted thereto, so that the cone or cavetto formed by the bending between the inner circumferential surface of plugging opening 26 and the associated outside of plate portion 23, and bounded on the inner circumference of end portion 8 of connecting member 6, would be accessible from the outside for receiving e.g. a weld seam and collar 27 could be simultaneously used for the centered alignment of connecting piece 20 relative to insulator 10. Appropriately the outer face bounding the plugging opening 26 remote from the insulator 10 or end face 19 and which in the represented embodiment is formed by the free circular face of collar 27, is substantially located in the plane of the end face of the end portion 8 engaging in the plugging opening 26. End portion 8 need only project over end face 19 by a small amount, e.g. roughly its diameter or double the plate thickness of plate portion 23.

The end of insulator 10 belonging to end face 19 is constructed as an engaging member 30 for positive connection to the fixing part 21 of connecting piece 20 to the extent that this connection prevents rotary movements about central axis 9 and movements radial thereto. For the formation of engagement member 30, the insulator 10 is provided with several projections 28 located in the vicinity of the four corners of end face 19 and projecting beyond the end face 19 by roughly the same distance as end portion 8 and which appropriately connect continuously to circumferential surface 17 and to this extent on the associated end of insulator 10 define an engagement recess 29, whose planar base 31 is formed by end face 19.

The fixing part 21 or plate portion 23 is provided on its outer boundary with a contracting cutout closely adapted thereto for each projection 28, so that in the represented embodiment there is a cruciform basic shape of plate portion 23 with four projections roughly located in the plate plane and which in each case engage between two adjacent projections 28. Between the fixing part 21 of connecting piece 20 and insulator 10, there can also be a direct, axially securing connection, e.g. a snap connection and in the case of constructing the insulator 10 from a ceramic material, the resilient snap members are appropriately formed by the fixing part 21 and when forming the insulator 10 from a plastics material, instead of or in addition thereto the resilient snap members can be formed by the insulator 10. For example, the projections 28 can be provided on their sides engaging in the cutouts with projecting snap noses, which engage over the plate portion 23 on the side remote from end face 19.

For the connection of end piece 1 to tubular heater 2, initially the insulator 10 alone and then the connecting piece 20 or the insulator 10 together with connecting piece 20 can be engaged as a premounted assembly on end portion 7, 8. The fixing part 21 is then so connected exclusively to the end portion 8 of connecting member 6 by means of a spot welding head 33, that the end face of end portion 8 is completely covered over the circumference of plugging opening 26 and substantially no part of the connecting member 6 is exposed. Welding head 33 appropriately extends at the furthest up to the outer circumference of collar 27 and to whose face it is also connected by welding adhesion. The transitions between the plate portion 23 and the profile legs 24 form joint-like bending joint zones 32 for the associated connecting element 25, which is consequently angularly variable with respect to the central axis 9 and therefore adjustable to the desired alignment.

As shown in FIG. 3, the connecting piece **20*a* can have more than two connecting elements 25, e.g. four elements 25*a*, uniformly distributed around the central axis of the plugging opening 26*a* or collar 27*a* and projecting from plate portion 23*a***.

In FIGS. 4 to 7 corresponding parts are given the same reference numerals as in the remaining drawings, but in FIGS. 4 and 5 are followed by the letter "b" and in FIGS. 6 and 7 by the letter "c".

In the embodiment according to FIGS. 4 and 5 the outer circumference of insulator **10*b* is substantially rotationally symmetrical or approximately cylindrical, but is eccentric to the central axis 9*b* of passage 16*b* and therefore to the associated end portion of the tubular heater. Instead of being approximately parallel to the central axis as in FIGS. 1 and 2, in this case the two connecting elements 25*b* project at or approximately at right angles to the central axis 9*b* beyond insulator 10*b*, being displaced with respect to one another in the direction of central axis 9*b* and in approximately parallel planes. On the side where the connecting elements 25*b* project over insulator 10*b* in the axial view according to FIG. 5, the outer circumference of the insulator is provided with a flattened portion 34 over its entire length, so that in the case of relatively small length of the connecting elements 25*b*, the mating connector can be engaged up to the flattened portion 34**.

The cross-sectionally U-shaped fixing part **21*b* of connecting piece 20*b* is in this case arranged in such a way that the plate portion 23*b* is formed by a profile leg, which passes into one of the two connecting elements 25*b*, which is therefore substantially caplanar with the recess base 31*b*. In cross-section, the profile cross-web 24*b* is approximately parallel to the central axis 9*b* and projects approximately at right angles from the recess bottom 31*b*. Its outside is located directly adjacent to the parallel inside of one only two projections 28*b* and projects beyond these projections 28*b*. The engagement recess 29*b*, in axial view according to FIG. 5, tapers in an acute angled manner with increasing distance from connecting part 22*b*. For this purpose, the facing inner faces of the varyingly large, circular segment-like bounded projections 28*b* on either side of passage 26*b* are correspondingly at acute angles to one another. Fixing part 21*b*, formed by an angle profile, has a shape adapted to the basic shape of the engagement recess 29*b*, so that the longitudinal edge of plate portion 23*b* remote from cross-web 24*b* is correspondingly bevelled. Therefore this longitudinal edge is inclined with respect to the longitudinal extension of connecting element 25*b*, whereas cross-web 24*b* and the inner face of the associated projection 28*b* are parallel thereto. This gives a wedge profile, which secures the connection between the connecting piece 20*b* and the insulator 10*b*, particularly against those forces occurring on engaging the mating connector on connecting elements 25*b*. This also ensures a very precise orientation of the fixing part 21*b* with respect to the insulator 10*b*, to the extent that when the fixing part 21*b* strikes against the inner faces of the engagement recess 29*b*, plugging opening 26*b* is precisely aligned with respect to the passage 16*b*. The profile leg located outside recess 29*b* and forming the second connecting element 25*b* can, in the axial view according to FIG. 5, project over plate portion 23*b*** or be bounded in a congruent manner.

Passage **16*b* is much closer to the inner boundary of the engagement recess 29*b* parallel to the longitudinal direction of connecting part 22*b*, so that the plugging opening 26*b* is immediately adjacent to the inside of the profile cross-web 24*b*. Individual plugging openings 26*b* are provided equiaxially to one another in both profile legs of the fixing part 21*b*, so that compared with their axial extension they have a much larger reciprocal spacing. Between these individual plugging openings 26*b* is provided on the inside of the profile cross-web 24*b* a groove-like longitudinal guide 35 parallel to the central axis 9*b* for the end portion of the connecting member of the tubular heater. This longitudinal guide 35 can be formed in simple manner by two parallel, e.g. bead-like projections 36 defining carrugations shaped out of the fixing part 21*b* and which are located on either side of the connecting member. This longitudinal guide 35 also advantageously absorbs those forces which occur on removing the mating connector from a connecting element 25b. With respect to the central axis of the outer circumference of insulator 10b, the central axis 9b of socket 12b or the passage 16b is displaced in the direction towards the flattened portion 34 or the connecting part 22b and also at right angles thereto in the direction towards the inner surface of engagement recess 29b, approximately parallel to the longitudinal direction of the connecting part 22b and which is formed by the smaller projection 28b**.

In the embodiment according to FIGS. 6 and 7, the connecting piece 20c is provided with a cross seam or welt 37 at right angles to its two connecting elements 25c in the center of the plate portion 23c and whose seam legs 38, substantially symmetrical to an axial plane of the plugging opening 26c, directly engage on one another on either side of plugging opening 26c and are curved away from one another in part circular or semicircular manner for forming the plugging opening 26c between the ends of cross seam 37. The height of the cross seam 37 and therefore the length of plugging opening 26c are in this case much larger than the diameter of plugging opening 26c and only slightly shorter than the profile legs forming the connecting elements 25c. The welded joint between the casing 27c of plugging opening 26c formed by the seam leg 38 and the end portion 8c of the connecting member, can in this case be made from the outside e.g. by welding tongs or on the closed end wall of the plugging opening 26c formed by the seam apex and on which appropriately engages the end portion 8c of the connecting member. In both cases the welding material is formed by the parts to be joined together.

As shown in FIG. 8, the plugging opening 26d can also be open at the end, so that the casing 27d forms a two-shell face in the plane of the end face of the end portion 8d for receiving the welding spot or head 33d. The two shell halves are formed by the two seam legs, whose seam bend is consequently subdivided into two parts, which extend up to the two-shell face and can project with their facing end faces over said face in such a way that in the vicinity of the outer circumference of the face they form two facing boundary cams for the welding head.

I claim:

1. An end piece for a tubular heater having a heating resistor inside a tube casing, said end piece comprising:

an insulator member having an engagement part for engaging the tube casing of said tubular heater and a passage for a connecting member connected to the heating resistor inside said tube casing, said insulator member having at least one engagement member located outside the tube casing, and wherein at least one said at least one engagement member is provided for receiving a fixing part of at least one connecting piece to be connected to the connecting member, said engagement member being axially spaced from an associated end of the tube casing and forming at least one connecting element providing a plug.

2. An end piece for a tubular heater having a heating resistor inside a tube casing, said end piece comprising:

an insulator member having an engagement part for engaging the tube casing of said tubular heater and a passage for a connecting member connected to the heating resistor inside said tube casing, said insulator member having at least one engagement member located outside the tube casing, and wherein at least one said at least one engagement member is provided for receiving a fixing part of at least one connecting piece in a rotationally secured manner with respect to a central axis of said tube casing and in a secured manner with respect to movements transverse to the connecting member, said engagement member providing an engagement recess for said connecting piece, said engagement recess being bounded by at least two facing end projections and having a recess base formed by an associated end wall of a socket of said insulator member.

3. The end piece according to claim 1 or 2, wherein at least one connecting element of said connecting piece is accessible for connection to an electric supply line, said fixing part having at least one plugging opening adapted to receive an associated end portion of the connecting member, said plugging opening being located in an extension of said passage, said connecting element being laterally disposed and spaced from said plugging opening.

4. The end piece according to claim 1 or 2, wherein at least one fixing part of at least one said connecting piece for the tubular heater has at least one plate portion formed by a profile portion of a sheet metal profile forming a U-profile, said plate portion being provided to engage the insulator member on a recessed base, said plate portion being closely adapted to a contour of an engagement recess and passing with at least one profile leg into a connecting element.

5. The end piece according to claim 4, wherein at least one said plate portion is formed by a profile cross-web having a center and a plugging opening for the connecting member in said center.

6. The end piece according to claim 4, wherein said at least one plate portion is formed by a first profile leg having a first plugging opening directly adjacent to an inside of a profile cross-web, a second plugging opening for the connecting member being provided in a facing second profile leg.

7. The end piece according to claim 6, wherein said engagement recess provided for receiving said connecting piece is tapered substantially counter to a projecting direction of a connecting part projecting transverse to a central axis of said insulator member, said engagement recess providing a stop-limiting wedge guide.

8. The end piece according to claim 3, wherein at least one plugging opening of said fixing part has an axial extension larger than a thickness of a portion traversed by said plugging opening, bounded by an annular face associated with a free end of said connecting member, a plate portion of said connecting piece being shaped to form a collar bounding said at least one plugging opening and being directed away from said insulator member.

9. The end piece according to claim 3, wherein at least one said at least one plugging opening is bounded at one end in blind hole-like manner, said plugging opening being several times longer than a cross-sectional width of the connecting member, a plate portion of said connecting piece being provided with a cross seam having seam legs located on either side of the connecting member.

10. The end piece according to claim 3, wherein at least one said at least one connecting piece, in addition to at least one plugging opening has a longitudinal guide for the connecting member, said longitudinal guide providing projections located on an inside of the connecting member, said projections being reinforcing corrugations located between two separate plugging openings.

11. The end piece according to claim 1 or 2, wherein at least one said at least one connecting piece has between at least two and four facing connecting elements, forming flat plugging tongues, connected by means of bending joint zones in angularly variable manner to a fixing part.

12. The end piece according to claim 1 or 2, wherein at least one connecting piece and the insulator member are secured by means of at least one welded joint with respect to an associated end portion of said connecting member of the tubular heater, an end face of the connecting member being covered by a welding head directly formed by an end wall of a blind hole-like plugging opening.

13. The end piece according to claim 1 or 2, wherein a tube casing engagement member is provided for surrounding an outer circumference of said tube casing in a manner of a sleeve-like outer socket having said passage in an end wall and at least one said at least one engagement member on an outer end side.

14. The end piece according to claim 1 or 2, wherein the insulator member has a ring plug traversed by said passage and provided for engaging in the tube casing, said ring plug being substantially shorter than an outer tube casing engagement member surrounding said ring plug, an annular groove being formed between said ring plug and said tube casing engagement member, said annular groove being adapted to said casing, said ring plug being conically tapered by an acute angle towards a free end remote from a connection engagement member of said insulator member.

15. An end piece for an end of a tubular heater having a heating resistor inside a tube casing, said end piece comprising:

an insulator member adapted to be connected with associated members provided by the end of the tubular heater to a supply line, wherein said connecting piece has between one and a plurality of separate connecting plugs, each provided for connection to a supply line.

16. The end piece according to claim 15, wherein said connecting piece together with said between one and said plurality of separate connecting plugs is made in one part from sheet metal.

17. An end piece for an end of a tubular heater having a heating resistor inside a tube casing, said end piece comprising:

an insulator member adapted to be connected with associated members provided by the end of the tubular heater and an electrical connecting piece for connection of the tubular heater to a supply line, wherein said connecting piece has between one and three plate portions adapted for direct engagement with said connecting member.

18. The end piece according to claim 17, wherein at least one said at least one said plate portion is located transverse to said connecting member.

19. The end piece according to claim 17, wherein said plate portion is located substantially parallel and directly adjacent to said connecting member.

20. An end piece for an end of a tubular heater having a heating resistor inside a tube casing, said end piece comprising:

an insulator member adapted to be connected with associated members provided by the end of the tubular heater and an electrical connecting piece for connection of the tubular heater to a supply line, wherein separate longitudinal guides for the connecting member are provided on said electrical connecting piece, each of the guides providing one of the members provided by a bore and a groove.

21. An end piece for an end of a tubular heater having a heating resistor inside a tube casing, said end piece comprising:

an insulator member adapted to be connected with associated members provided by the end of the tubular heater and an electrical connecting piece for connection of the tubular heater to a supply line;

at least one engagement member provided by said insulator member for connection to said associated members, wherein said engagement member is adapted for non-rotationally receiving and engaging said associated member in a positively securing manner.

22. The end piece according to claim 21, wherein said engagement member provides an engagement groove adapted for receiving a portion of said connecting piece.

23. The end piece according to claim 22, wherein said groove is provided in an end face of said insulator member, a longitudinal extension of said groove being transverse to said connecting member.

24. The end piece according to claim 2, wherein said engagement recess provided for receiving said connecting piece is tapered substantially counter to a projecting direction of a connecting part projecting transverse to a central axis of said insulator member, said engagement recess providing a stop-limiting wedge guide.

* * * * *